US008342439B2

(12) United States Patent
Iwatsuki

(10) Patent No.: US 8,342,439 B2
(45) Date of Patent: Jan. 1, 2013

(54) MEDIA STORING AND FEEDING DEVICE WITH MAXIMUM ANGULAR SPEED OF REELS REDUCED

(75) Inventor: Kei Iwatsuki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 487 days.

(21) Appl. No.: 12/232,780

(22) Filed: Sep. 24, 2008

(65) Prior Publication Data

US 2009/0108115 A1 Apr. 30, 2009

(30) Foreign Application Priority Data

Oct. 31, 2007 (JP) ..... 2007-284264

(51) Int. Cl.
*B65H 39/14* (2006.01)

(52) U.S. Cl. ..... 242/528; 271/216

(58) Field of Classification Search ..... 242/528; 271/3.01, 216

See application file for complete search history.

(56) References Cited

U.S. PATENT DOCUMENTS

| | | | | |
|---|---|---|---|---|
| 4,871,125 | A * | 10/1989 | Haueter | 242/528 |
| 5,064,074 | A | 11/1991 | Edin et al. | |
| 5,680,935 | A * | 10/1997 | Mistander et al. | 209/534 |
| 6,071,023 | A * | 6/2000 | Takeuchi et al. | 242/528 |
| 6,669,136 | B2 * | 12/2003 | Niioka et al. | 242/528 |
| 7,293,735 | B1 * | 11/2007 | Neumann et al. | 242/528 |
| 7,654,485 | B2 * | 2/2010 | Rossel et al. | 242/528 |
| 2002/0096816 | A1 * | 7/2002 | Sasaki et al. | 271/3.14 |
| 2006/0090983 | A1 * | 5/2006 | Katou et al. | 194/206 |
| 2007/0221776 | A1 * | 9/2007 | Rossel et al. | 242/528 |

FOREIGN PATENT DOCUMENTS

| | | |
|---|---|---|
| JP | 58-012558 | 1/1983 |
| JP | 08-067382 | 3/1996 |

* cited by examiner

*Primary Examiner* — William A Rivera

(74) *Attorney, Agent, or Firm* — Rabin & Berdo, P.C.

(57) ABSTRACT

In a media storing and feeding device for winding up or rewinding the tapes between reels attached to reel shafts and a drum 120 by torque limiters to feed or store the medium, at the time of feeding the medium, the reel shafts are rotated at a speed faster than a speed at which the drum rewinds the tapes, and at the time of storing the medium, the reel shafts are rotated at a speed slower than a speed at which the drum winds up the tapes. A difference between the rotational speeds of the reel shafts and the reels is absorbed by the torque limiters. The media storing and feeding device is thus implemented by inexpensive torque limiters which operate at low speed in place of expensive torque limiters supporting high speed.

7 Claims, 13 Drawing Sheets

MEDIA STORING AND FEEDING DEVICE WITH MAXIMUM ANGULAR SPEED OF REELS REDUCED

BACKGROUND OF THE INVENTION

1. Field of the Invention

The present invention relates to a media storing and feeding device, and more specifically to a device that stores and feeds leaf-like media such as bank bills, checks, deeds or instruments by winding up and rewinding a tape or tapes between a drum and reels for use in a bill depositing and withdrawing machine, a check/deed collecting and issuing machine, a bank bill/check/deed delivery system, or the like.

2. Description of the Background Art

Conventionally, as devices that store and feed leaf-like media by winding up and rewinding a tape or tapes between a drum and reels, there are a type of system using two tapes, as disclosed by, for example, U.S. Pat. No. 5,064,074 to Edin et al., and another type of system using a single tape as disclosed by, for example, Japanese Patent Laid-Open Publication No. 12558/1983. Further, as for a system to drive a tape or tapes, Edin et al., uses a plurality of motors, and, for example, Japanese Patent Laid-Open Publication No. 67382/1996 uses a single motor to drive the tape.

The system in which two tapes are used and are driven by one motor will be described hereinafter with reference to FIGS. 30 and 31, which explanatorily show the main part of the system in a side and a plan view, respectively. In the figures, reference numeral 100 denotes a storing and feeding device. Reference numerals 110 and 115 denote tapes, which have the same shape and length as each other. The tapes 110 and 115 have one end wound around a drum 120 and the other end wound around reels 130 and 135.

The drum 120 is adapted to wind up a medium 300 pinched between the tapes 110 and 115 along with the tapes 110 and 115, and is fixed on a drum shaft 121. Further, the reels 130 and 135 are adapted to wind up only the tapes 110 and 115, and both reels 130 and 135 have the same shape. Both reels 130 and 135 are attached to respective reel shafts 131 and 136 via torque limiters 132 and 137.

Reference numeral 185 denotes a media infeed-and-outfeed opening, which is located outside a media storing and feeding device 100. A medium conveyed from a conveyance unit, not shown, is taken into the media storing and feeding device 100 from the media infeed-and-outfeed opening 185. Idle pulleys 190 and 195 for the tapes 110 and 115 are mounted in the media infeed-and-outfeed opening 185, and the tapes 110 and 115 are wound around the reels 130 and 135 via the idle pulleys 190 and 195 from the drum 120.

Reference numeral 105 denotes a frame for the media storing and feeding device 100, and the drum shaft 121 is attached to the frame 105 via a bearing 106. The drum shaft 121 is configured to freely rotate with respect to the frame 105 by the bearing 106. Reference numeral 140 is directed to a driving motor that transmits a drive force to a drum gear 142. The drum gear 142 is fixed to the drum shaft 121, so that, when the driving motor 140 rotates, the drum shaft 121 and the drum 120 are rotated.

With respect to the drum shaft 121 and the reel shafts 131 and 136, the following drive transmission means is provided. A drum gear 150 is attached to the drum shaft 121, and engaged with reel gears 155 and 160. The reel gears 155 and 160 have the same number of teeth as each other, and are attached to the reel shafts 131 and 136 via one-way clutches 165 and 170.

Further, the reel shafts 131 and 136 are attached to the frame 105 via one-way clutches 175 and 180. With respect to the one-way clutches 165 and 170, when the reel gears 155 and 160 rotate the reels 130 and 135 in the wind-up direction thereof, the one-way clutches 165 and 170 are locked, and the rotations of the reel gears 155 and 160 are transmitted to the reel shafts 131 and 136.

By contrast, when the drum gear 150 rotates the reels 130 and 135 in the rewinding direction thereof, the one-way clutches 165 and 170 are rotated in the idling direction thereof, so that the rotations of the reel gears 155 and 160 are not transmitted to the reel shafts 131 and 136. Further, with respect to the one-way clutches 175 and 180, when the reel shafts 131 and 136 are rotated in a direction in which the tapes 110 and 115 are wound up by the reels 130 and 135, the one-way clutches 175 and 180 are idled. When the reel shafts 131 and 136 make an attempt to rotate in a direction in which the tapes 110 and 115 are rewound by the reels 130 and 135, the one-way clutches 175 and 180 are locked, and are not rotated in the rewinding direction.

The gear ratio of the drum gear 150 and the reel gears 155 and 160 is set such that, when the drum 120 rewinds the tapes 110 and 115, a speed at which the reels 130 and 135 wind up the tapes 110 and 115 is always faster than a speed at which the drum 120 rewinds the tapes 110 and 115. The details thereof will follow.

FIG. 32 explanatorily shows how the drum rewinds the tapes. Given that the tape wound-up radius of the reels 130 and 135 is RA1, the tape wound-up radius of the drum 120 side is RA2, the number of gear teeth and the angular speed of the drum gear 150 are ZA2 and WA2, respectively, the number of gear teeth and the angular speed of the reel gears 155 and 160 are ZA1 and WA1, respectively, a tape winding-up speed by the reel shafts 131 and 136 is VA1, and the tape rewinding speed of the drum shaft 121 is VA2, then the expression $$VA1=RA1\times WA1,\ VA2=RA2\times WA2 \tag{1}$$

is formed.

In order to set the gear ratio such that a speed at which the reel shafts 131 and 130 wind up the tapes is faster than a speed at which the drum 120 rewinds the tapes 110 and 115, the relationship between the speeds of VA1 and VA2 always secures $$VA1>VA2. \tag{2}$$

According to the expressions (1) and (2), $$RA1\times WA1>RA2\times WA2\rightarrow RA1/RA2>WA2/WA1. \tag{3}$$

Because the ratio between angular speeds is determined by a gear ratio, $$WA2/WA1=ZA1/ZA2. \tag{4}$$

According to the expressions (3) and (4), $$RA1/RA2>ZA1/ZA2. \tag{5}$$

Note that, the more the media are fed out, the larger the reel radius RA1 is and the smaller the drum radius RA2 is. With respect to RA1 and RA2 according to changes in radii, the following relational expressions hold as follows.

$$RA1=ra1\times ka1, \tag{6}$$

$$RA2=ra2\times ka2, \tag{7}$$

where ra1 is a reel radius on which there are no tapes wound, and ka1 is a coefficient in which a reel radius is increased by winding up a tape.

Given that ka1 is equal to unity when there is no tape wound on the reel, i.e. when the media is stored fully in the storage capacity of the drum 120, and ka1 is equal to T1 when the tapes are fully wound on the reels, i.e. when there are no tapes on the drum 120, then with respect to ka1, $$1 \leqq ka1 \leqq T1 (1 < T1) \quad (8)$$

is formed, where ra2 is the radius of the drum on which there are no tapes wound, and ka2 is a coefficient in which the radius of the drum is increased by winding up the tapes.

Given that ka2 is equal to unity when there are no tapes on the drum 120, and ka2 is equal to T2 when the media are fully stored in the storage capacity of the drum 120, with respect to ka 2, $$1 \leqq ka2 \leqq T2 (1 < T2) \quad (9)$$

is formed.

Because the minimum value of RA1/RA2 is attained when RA1 is of its minimum value and RA2 is of its maximum value, according to expressions (6), (7), (8) and (9), the minimum value of RA1/RA2 equal to (ra1×1)/(ra2×T2). In order to always secure expression (5), it is necessary to satisfy expression (5) with the minimum value of RA1/RA2. Therefore, $$ra1/(ra2 \times T2) > ZA1/ZA2. \quad (10)$$

By setting the above-described gear ratio, it is secured that the relationship between the speeds of VA1 and VA2 always holds the relationship of VA1>VA2 even when the drum radius and the reel radii are changed by winding-up and rewinding the tapes.

In this way, the gear ratio is set such that a speed at which the reels wind up the tapes is always faster than a speed at which the drum rewinds the tapes. A feeding operation of the media storing and feeding device 100 will be described hereinafter with reference to FIG. 33. The driving motor 140 rotates the drum 120 in the direction of arrow a1. At this time, because the reel gears 155 and 160 are rotated in the direction of arrow a2 which is a reel winding-up direction via the drum gear 150, the one-way clutches 165 and 170 are locked, and the rotations of the reel gears 155 and 160 are transmitted to the reel shafts 131 and 136.

Therefore, the reel shafts 131 and 136 are rotated in the direction of arrow a3, and the one-way clutches 175 and 180 are idled. It is thus possible for the reel shafts 131 and 136 to be rotated. Further, at this time, because the gear ratio is set such that a speed at which the reel shafts 131 and 136 wind up the tapes 110 and 115 is always faster than a speed at which the drum 120 rewinds the tapes 110 and 115 in order to satisfy the above-described expression (10), a difference between the speeds is absorbed by the rotations of the torque limiters 132 and 137 between the reels 130 and 135 and reel shafts 131 and 136. Therefore, tensions are always applied to the tapes 110 and 115 by the torque limiters 132 and 137.

In accordance therewith, because the drum 120 is rotated in the direction of arrow a1 while rewinding the tapes 110 and 115 in a state in which tensions are always applied to the tapes 110 and 115, a medium 310 pinched between the tapes 110 and 115 is fed out of the drum 120 by the rewinding of the drum 120, and the medium 310 runs between the tapes 110 and 115 to be discharged from the media infeed-and-outfeed opening 185.

A storing operation of the media storing and feeding device 100 will be described with reference to FIG. 34. When a medium 320 is conveyed into the media storing and feeding device 100 from media infeed-and-outfeed opening 185, the driving motor 140 rotates the drum 120 in the direction of arrow b1. At this time, because the reel gears 155 and 160 are rotated in the direction of arrow b2 which is a reel rewinding direction, the one-way clutches 165 and 170 are idled, and the rotations of the reel gears 155 and 160 are not transmitted to the reel shafts 131 and 136.

Therefore, the drive is transmitted to only the drum 120, and the drum 120 is rotated in the direction of arrow b1. At this time, because the tapes 110 and 115 are wound up on the drum 120 by the rotation of the drum 120, force to rotate those in the rewinding direction is applied to the reels 130 and 135 by the tapes. At this time, the force is applied to the reel shafts 131 and 136 so as to rewind the tapes. However, because those are locked by the one-way clutches 175 and 180, the reel shafts 131 and 136 are not rotated in the rewinding direction.

Thus, the force is applied to the reels 130 and 135 in the rotational direction by the tapes. However, because the reel shafts 131 and 136 are not rotated, the torque limiters 132 and 137 between the reels 130 and 135 and the reel shafts 131 and 136 are rotated, which rotates the reels 130 and 135, and the tapes 110 and 115 are wound up on the drum 120 from the reels 130 and 135. Therefore, the tapes 110 and 115 are in a state in which tensions are always applied thereto by the torque from the torque limiters 132 and 137.

In this way, the medium 320 coming from the media infeed-and-outfeed opening 185 is wound up on the drum 120 while being pinched between the tapes 110 and 115, and the medium is stored. Thus, in storing and feeding operations, when the tapes 110 and 115 are loosened, there is a problem such that the tapes 110 and 115 come free from the idle pulleys 190 and 195 or the reels 130 and 135, or the force pinching a medium at the time of rewinding disappears. However, in the above-described storing and feeding operations, the tensions are always applied to the tapes, which do not allow the tapes to be loosened.

However, under the prior art described above, because the reel shafts 131 and 136 always rotate slower than the reels 130 and 135 in the feeding operation, the torque limiters 132 and 137 are always rotated. Further, in the storing operation, because the reels 130 and 135 are rotated with respect to the reel shafts 131 and 136 which are not rotated, the torque limiters 132 and 137 are always rotated.

Given that the angular speed of the torque limiters in the feeding operation is TA1, and the angular speed of the torque limiters in the storing operation is TA2, then $$TA1 = (\text{angular speed of the reel shafts})/(\text{angular speed of the reels}), \quad (11)$$

$$TA2 = (\text{angular speed of the reels}). \quad (12)$$

In the torque limiters, there is the problem that the greater the angular speed the shorter the lifetime. Further, the torque limiters supporting high rotational speed are expensive, so that torque limiters making an attempt to satisfy the quality and the cost are required to be used at low rotational speed.

Therefore, in the rotation in feeding operation, it is necessary to loose an angular speed by setting a ratio between the number of teeth ZA2 of the drum gear 150 and the number of teeth ZA1 of the reel gears 155 and 160 so as to decrease the angular speed, or rate, of TA1 as low as practical within the range of the relationship of (angular speed of the reel shafts) >(angular speed of the reels). Namely, it is necessary to increase the ratio of ZA1/ZA2 within a range in which expression (10) is satisfied. In the rotation in storing operation, because the angular speed of the reel shafts is stopped, the calculation is made by the tape speed VA1 and the reel radius RA1, thus $$TA2 = VA1/RA1. \quad (13)$$

Because the reel shafts are not rotated as in feeding operation, there is no factor to decrease the angular speed of the torque limiters with respect to the angular speed of the reels, and the angular speed of the torque limiters is increased in some cases.

A specific example N1 will be shown below. Given that a reel radius on which there are no tapes is ra1=50 mm, a coefficient in which a reel radius is increased when the tapes are fully wound thereon is T1=1.3, a drum radius on which there are no tapes is ra2=80 mm, a coefficient in which a drum radius is increased when the tapes are fully wound thereon is T2=1.5, and a speed of storing and feeding the tapes is VA=1200 mm/s, then the angular speed TA1 of the torque limiters in feeding operation is determined.

Given that a drum shaft angular speed WA2=VA1/RA2, a reel shaft angular speed $WA1=(ZA2/ZA1)\times WA2=(ZA2/ZA1)\times VA1/RA2$, a reel angular speed $WA3=VA1/RA1$, then according to expression (11), $$TA1=(ZA2/ZA1)\times VA1/RA2-VA1/RA1. \quad (14)$$

Because it is necessary to always satisfy expression (10) as the ratio of ZA2/ZA1, according to expression (10), $ra1/(ra2\times T2)>ZA1/ZA2$, $50/(80\times 1.5)>ZA1/ZA2$, $0.4167>ZA1/ZA2$, and $ZA1/ZA2=0.41$.

According to expression (14), $$TA1=(1/0.41)\times VA1/RA2-VA1/RA1=[(1/0.41)/RA2-[(1/0.41)/RA2-1/RA1]\times VA11/RA1]\times VA1$$

According to expressions (6) and (7), $$TA1=[(1/0.41)/(ra1\times ka2)-1/(ra1\times ka1)]\times VA1.$$

The maximum value as TA1 is established when (ra2×ka2) takes its the minimum value and (ra1×ka1) its maximum value, i.e. when there are no tapes on the drum 120, and the tapes are fully wound on the reels.

At that time, $$TA1(\text{maximum value})=[(1/0.41)/(ra2\times 1)-1/(ra1\times T1)]\times VA1=[1/(0.41)/80-1/(50\times 1.3)]\times 1200=18.12$$

On the other hand, to determine the angular speed of the torque limiters in storing operation, according to expression (13), $TA2=VA1/RA1$, and $TA2=VA1/(ra1\times ka1)$.

The maximum value as TA2 is established when (ra1×ka1) takes its minimum value, i.e. when there are no tapes on the reels. Then, $$TA2(\text{maximum value})=VA1/(ra1\times 1)]=1200/(50\times 1)=24. \quad (15)$$

In this way, in storing operation, because the reel shafts are not rotated as in feeding operation, the angular speed is increased in some cases. Further, in the prior art, in addition to the problem that the angular speed of the torque limiters is increased, there is a problem that it is necessary to use four one-way clutches which are expensive and are a factor to increase the cost.

SUMMARY OF THE INVENTION

It is an object of the present invention to provide an improved media storing and feeding device.

In accordance with the present invention, a media storing and feeding device includes a reel that winds up a tape, a reel shaft that rotates the reel, a torque limiter that attaches the reel to the reel shaft, and a drum that winds up the tape and a medium together, and is configured to wind up or rewind the tape between the reel and the drum to feed or store the medium. In the media storing and feeding device, at the time of feeding the medium, the reel shaft is rotated at a speed faster than a speed at which the drum rewinds the tape, and at the time of storing the medium, the reel shaft is rotated at a speed slower than a speed at which the drum winds up the tape, and a difference in rotational speed between the reel shaft and the reel is absorbed by the torque limiter.

In accordance with the present invention configured in this way, the reel shaft is rotated not only at the time of feeding the medium, but also at the time of storing the medium. It is therefore possible to greatly slow down the maximum angular speed in both of the storing and feeding operations, and the torque limiters can be used at low rotational speed, which makes it possible to obtain an advantageous effect that the lifetime of the torque limiters can be elongated. Moreover, it is possible to reduce the number of one-way clutches to be used.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
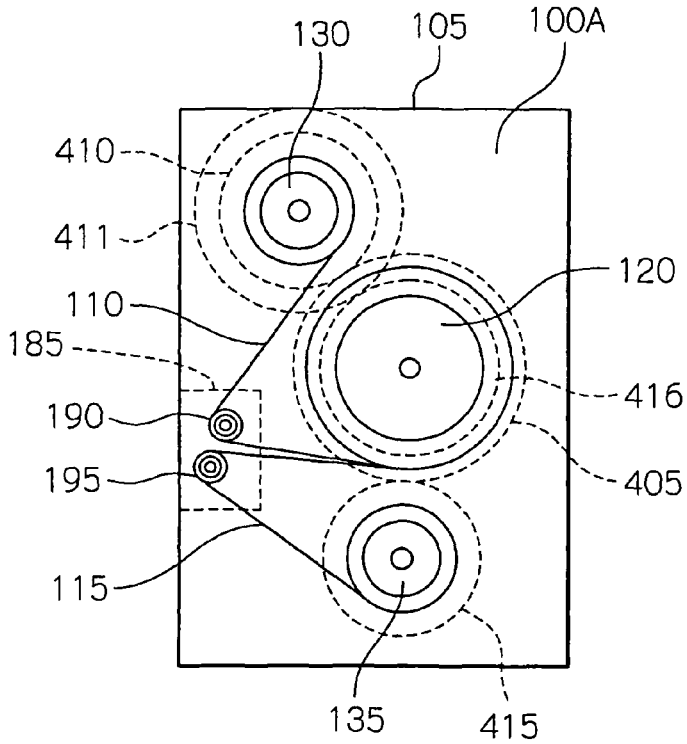
FIG. 1 explanatorily shows in a side view the main part of an embodiment of a media storing and feeding device in accordance with the present invention.
Figure 2:
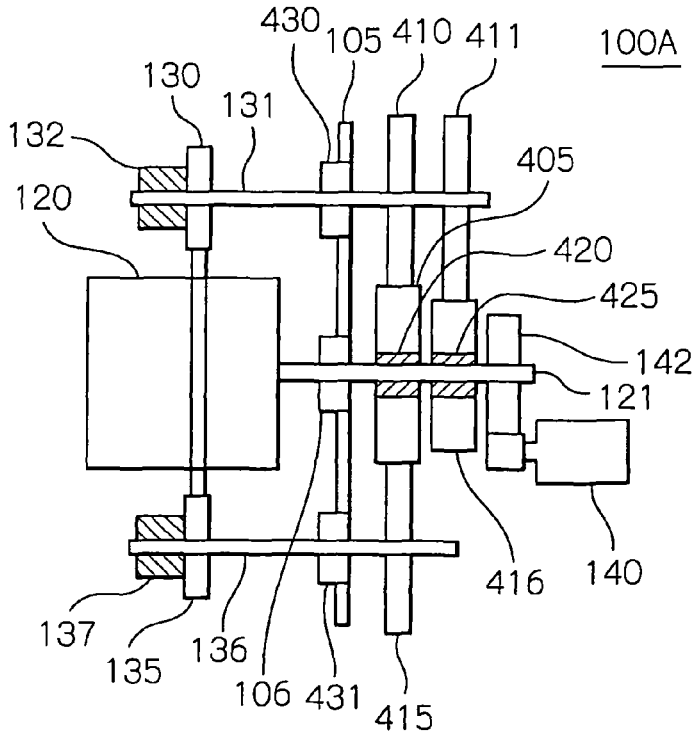
FIG. 2 explanatorily shows in a plan view the main part view of the embodiment shown in FIG. 1.

Preferred embodiments according to the present invention will be described with reference to the drawings. Reference is first made to FIGS. 1 and 2, which explanatorily show in a side and a plan view, respectively, the main part of an illustrative embodiment of a media storing and feeding device 100A in accordance with the present invention. In the following description, like portions and components will be designated with the same reference numerals even as to those of the prior art devices described above.

Figure 30:
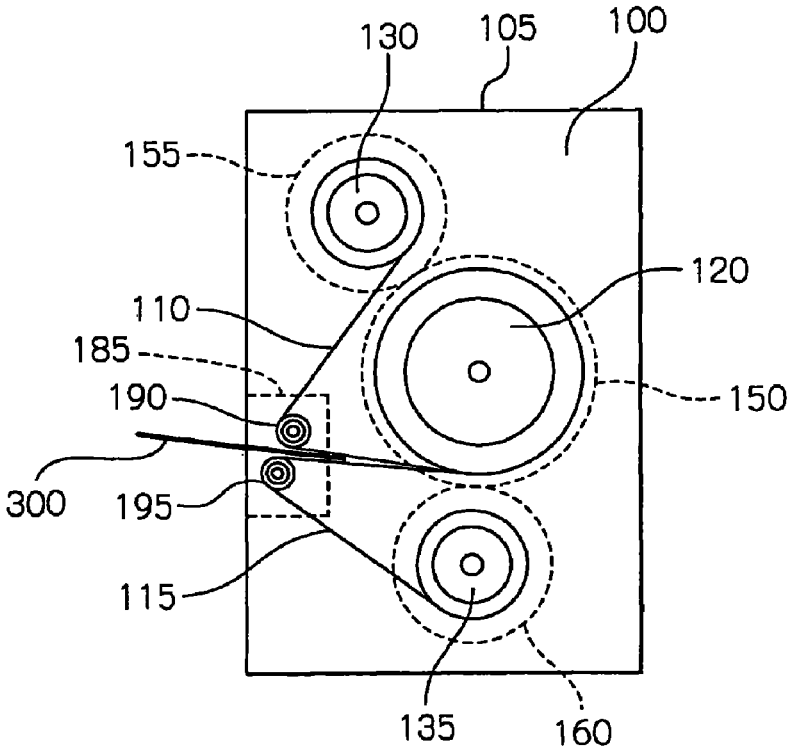
FIG. 30 PRIOR ART
FIG. 30 explanatorily shows in a side view the main part of a prior art example of media storing and feeding device.
Figure 31:
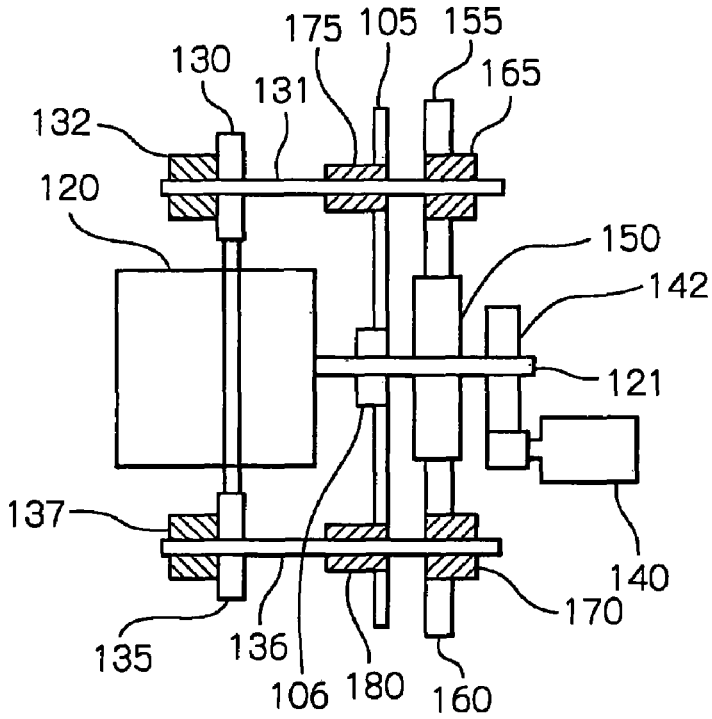
FIG. 31 PRIOR ART
FIG. 31 explanatorily shows in a plan view the main part of the prior art device shown in FIG. 30.
Figure 32:
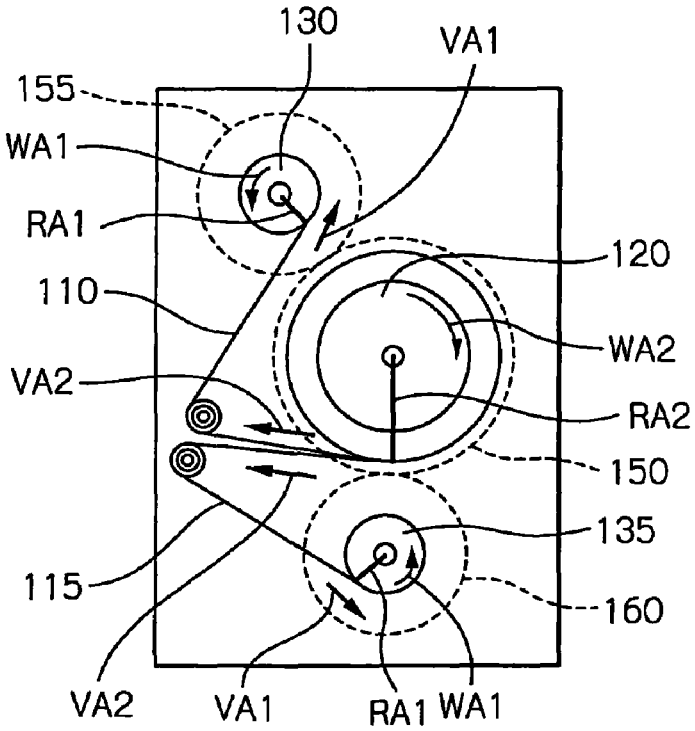
FIG. 32 PRIOR ART
FIG. 32 explanatorily shows how the drum rewinds the tapes in the prior art device shown in FIG. 30.
Figure 33:
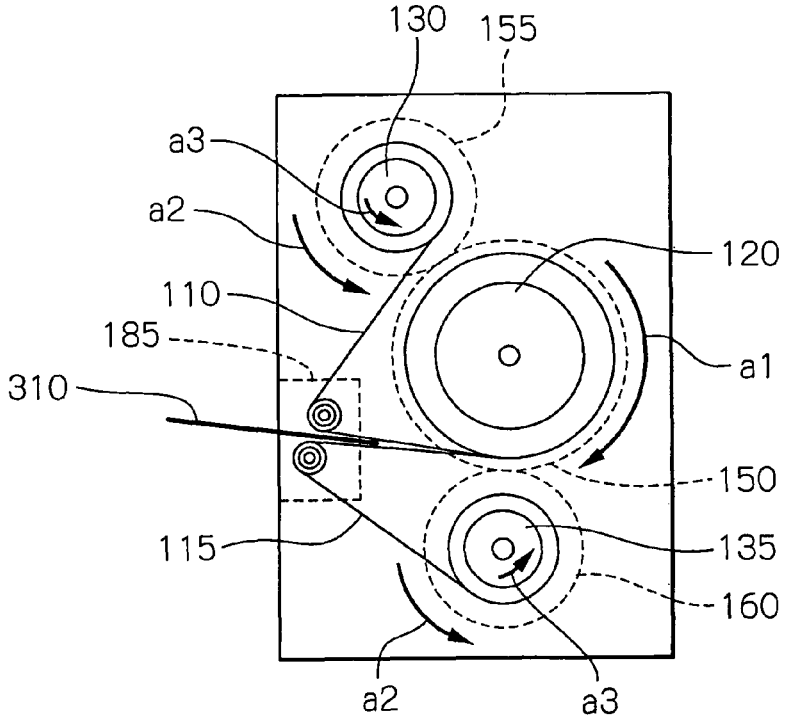
FIG. 33 PRIOR ART
FIG. 33 is an explanatory view useful for understanding the operation of feeding a medium of the prior art device.
Figure 34:
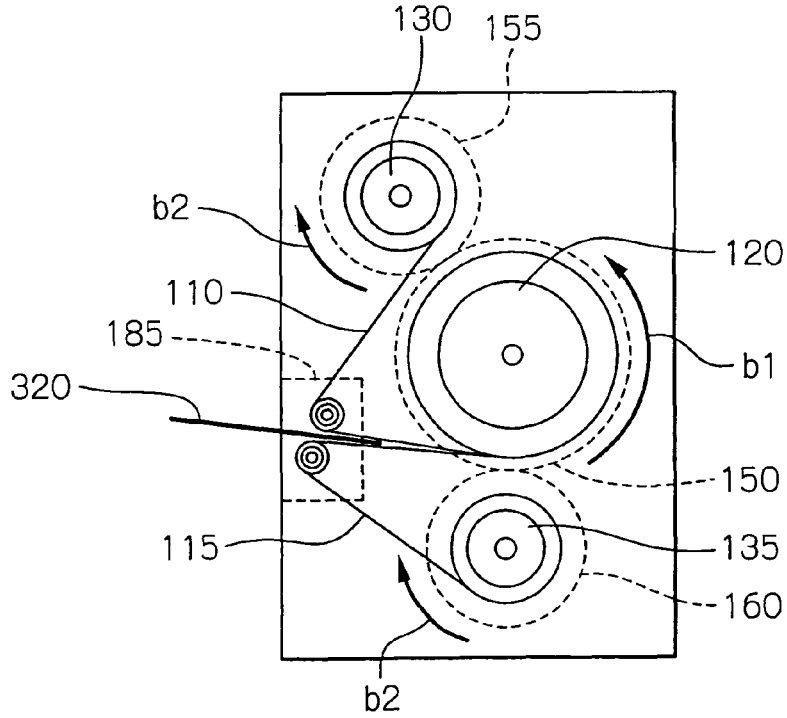
FIG. 34 PRIOR ART
FIG. 34 is an explanatory view useful for understanding the operation of storing a medium of the prior art device.

The media storing and feeding device 100A shown in the figures includes a drum gear 405, which is connected to a drum shaft 121 via a one-way clutch 420. The drum gear 405 has teeth ZA2 which are the same in number as the drum gear 150, FIG. 30. The device 100A also included reel gears 410 and 415 which are engaged with the drum gear 405, and are respectively fixed to the reel shafts 131 and 136. The reel gears 410 and 415 have respective teeth, of which the number ZA1 is the same as the reel gears 155 and 160.

The reel shafts 131 and 136 are attached to the frame 105 of the device 100A via bearings 430 and 431. The reel shafts 131 and 136 are configured to freely rotate with respect to the frame 105. The device 100A further includes a reel gear 411, which is fixed on the reel shaft 131, and has teeth of which the number is represented by ZA3.

Further, the media storing and feeding device 100A includes a drum gear 416, which is connected to the drum shaft 121 via a one-way clutch 425. The drum gear 416 has teeth, of which the number is equal to ZA4. With respect to the rotational directions of the one-way clutches 420 and 425, the one-way clutches 420 and 425 with the embodiment shown in FIG. 1 are locked and idled in the directions described in the following.

On the side of the one-way clutch 420, description will be made in detail with reference to FIGS. 3A-3D. As shown by the solid arrow in FIG. 3A, when the drum shaft 121 is rotated clockwise in the figure, the one-way clutch 420 is locked, and the one-way clutch 420 is rotated clockwise as shown by the dashed line arrow.

Figure 3A:
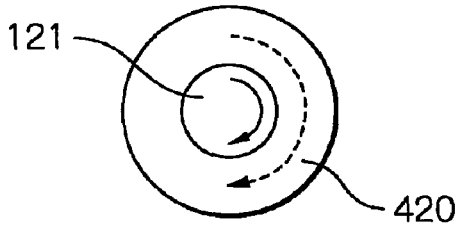
FIGS. 3A through 3D explanatorily show the rotational directions of the one-way clutch included in the embodiment.
Figure 3B:
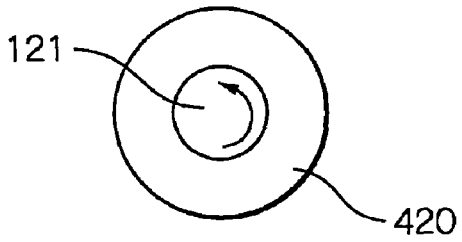

As shown by the solid arrow in FIG. 3B, when the drum shaft 121 is rotated counterclockwise, the one-way clutch 420 is not locked, and therefore the one-way clutch 420 is not rotated. As seen from the solid arrow in FIG. 3C, when the drum gear 405 is rotated clockwise, the one-way clutch 420 is idled, and therefore the drum shaft 121 is not rotated. As depicted by the solid arrow in FIG. 3D, when the drum gear 405 is rotated counterclockwise, the one-way clutch 420 is locked, and thus the drum shaft 121 is rotated counterclockwise.

Therefore, when the drum gear 416 is rotated in a direction in which the drum 120 winds up the tapes, i.e. counterclockwise, by the reel gear 411, the one-way clutch 425 is locked. At this time, given that the angular speed, or rate, of the reel shaft 131 is WA3, a tape rewinding speed is VA3, the angular speed of the drum is WA4, and a tape winding-up speed is VA4, a gear ratio is set such that ZA3 and ZA4 always hold the relationship of VA4>VA3.

More specifically, given that $$VA3=RA1\times WA3 \text{ and } VA4=RA2\times WA4,$$

$$VA3<VA4, \text{ and}$$

$$RA1\times WA3<RA2\times WA1\rightarrow RA1/RA2<WA4/WA3,$$

then, a ratio between the angular speeds is determined in accordance with a gear ratio, and therefore $$WA4/WA3=ZA3/ZA4, \text{ and}$$

$$RA1/RA2<ZA3/ZA4. \quad (21)$$

According to expressions (6) and (7), $$ZA3/ZA4>RA1/RA2=(ra1\times ka1)/(ra2\times ka2). \quad (22)$$

Since expression (21) has to always be satisfied, it has necessarily be satisfied with the maximum value of (ra1×ka1)/(ra2×ka2).

Because the maximum value of (ra1×ka1)/(ra2×ka2) is established when (ra1×ka1) is equal to its maximum value and (ra2×ka2) is to its minimum value, according to expressions (8) and (9), $$(ra1\times ka1)/(ra2\times ka2)\leqq(ra1\times T1)/(ra2\times 1). \quad (23)$$

Therefore, $$ZA3/ZA4>(ra1\times T1)/(ra2). \quad (24)$$

By setting the above-described gear ratio, it is secured that the relationship between the speeds of VA1 and VA2 always holds the relationship of VA4>VA3 even when the drum radius and the reel radii are changed by winding-up and rewinding the tapes.

In that way, the reel gear 411 and the drive gear 416 are set to have a gear ratio such that a speed at which the drum 120 winds up the tapes is faster than a speed at which the reels rewind the tapes.

Figure 4:
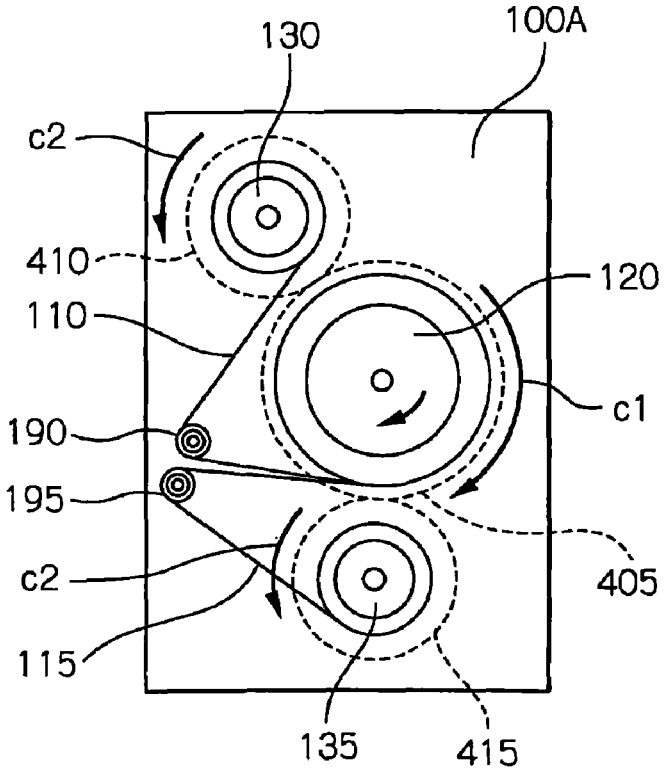
FIGS. 4 and 5 are explanatory views useful for understanding the rotational directions of the drum gear and reel gears included in the embodiment.

A feeding operation according to the above-described structure will be described hereinafter with reference to FIGS. 2 and 4. The driving motor 140 rotates in a direction in which the drum 120 rewinds the tapes, and the rotation is transmitted to the drum shaft 121 via the drum gear 142.

At this time, in the relationship between the drum shaft 121 and the one-way clutch 420, as shown in FIG. 3A, because the drum shaft 12 is rotated clockwise, the one-way clutch 420 is locked, and the one-way clutch 420 is rotated clockwise as shown by the dashed line arrow. Therefore, as shown in FIG. 4, the drum gear 405 is rotated in the direction of arrow c1, and the reel gears 410 and 415 are rotated in the direction of arrow c2.

The reel gears 410 and 415 are fixed to the reel shafts 131 and 136, and therefore the reel shafts 131 and 136 are rotated in the direction of arrow c2 which is the winding direction.

With respect to the rotational speed of the reel shafts 131 and 136, the number of teeth ZA2 of the drum gear 405 and the number of teeth ZA1 of the reel gears 410 and 415 satisfy expression (10), and therefore, when the drum 120 rewinds the tapes, due to the drum 120 rewinding the tapes, the rotation is faster than an amount of rotation of the reels 130 and 135 which are connected to the drum 120 through the tapes. A difference between the rotational speeds is absorbed by the torque limiters 132 and 137 connected between the reels 130 and 135 and the reel shafts 131 and 136.

Figure 5:
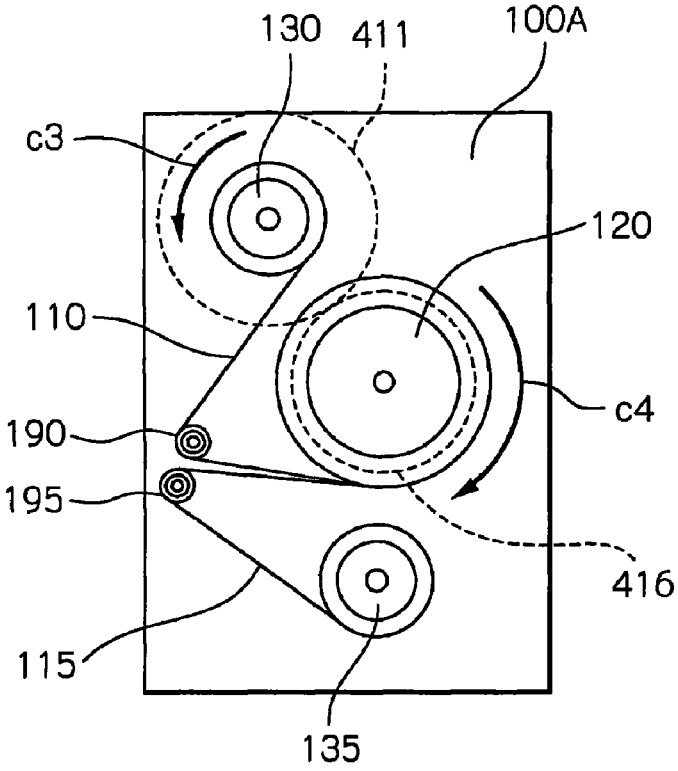

Further, as shown in FIG. 5, when the reel shaft 131 is rotated in the direction of arrow c2, the reel gear 411 is rotated in the direction of arrow c3. In accordance therewith, the drum gear 416 is rotated in the direction of arrow c4.

Since the angular speed WX2 of the drum gear 416 when the angular speed of the drum shaft 121 is WX1 is determined in accordance with the numbers of teeth of the drum gear 405, from which to the reel gear 410, from which to the reel gear 411, from which to the drum gear 416, $$WX2=(\text{number of teeth of the drum gear 405/number of teeth of the reel gear 410})\times(\text{number of teeth of the reel gear 411/number of teeth of the drum gear 416})\times WX1, \text{ and}$$

$$WX2=(ZA2/ZA1)\times(ZA3/ZA4)\times WX1 \tag{31}$$

According to expression (10), $$ra1/(ra2\times T2)>ZA1/ZA2, \text{ and}$$

$$ZA2/ZA1>(ra2\times T2)/ra1. \tag{32}$$

According to expressions (24) and (32), expression (31) is formed as $$WX2>[(ra2\times T2)/ra1]\times[(ra1\times T1)/ra2]\times WX1=[(ra2\times T2\times ra1\times T1)/(ra1\times ra2)]\times WX1=(T1\times T2)\times WX1.$$

According to expressions (8) and (9), because of the relationship 1<T1 and 1<T2, the relationship (T1×T2)>1 is formed, and $$WX2>WX1. \tag{33}$$

Figure 6:
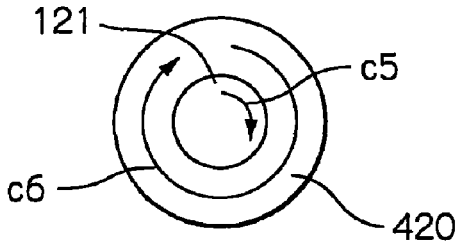
FIGS. 6 and 7 are explanatory views useful for understanding the rotational directions of the one-way clutch included in the embodiment.

Therefore, as shown in FIG. 6, as for the rotation of the one-way clutch 420 with respect to the drum shaft 121, the drum shaft 121 is rotated at the angular speed of WX1 clockwise as depicted by an arrow c5, and the one-way clutch 420 is rotated at the angular speed of WX2 clockwise as depicted by an arrow c6.

Figure 7:
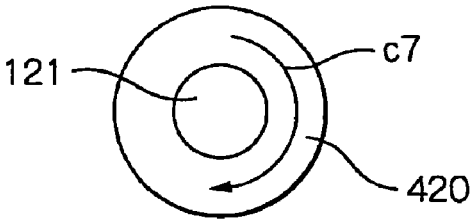

According to expression (33), because of the relationship WX2>WX1, as for the relative angular speed of the one-way clutch 420 with respect to the drum shaft 121, as shown in FIG. 7, the one-way clutch 420 is rotated clockwise as indicated by an arrow c7. In this case, as shown in FIG. 3B, the one-way clutch 420 is idled, and the rotation of the drum gear 416 is not transmitted to the drum shaft 121.

Figure 8:
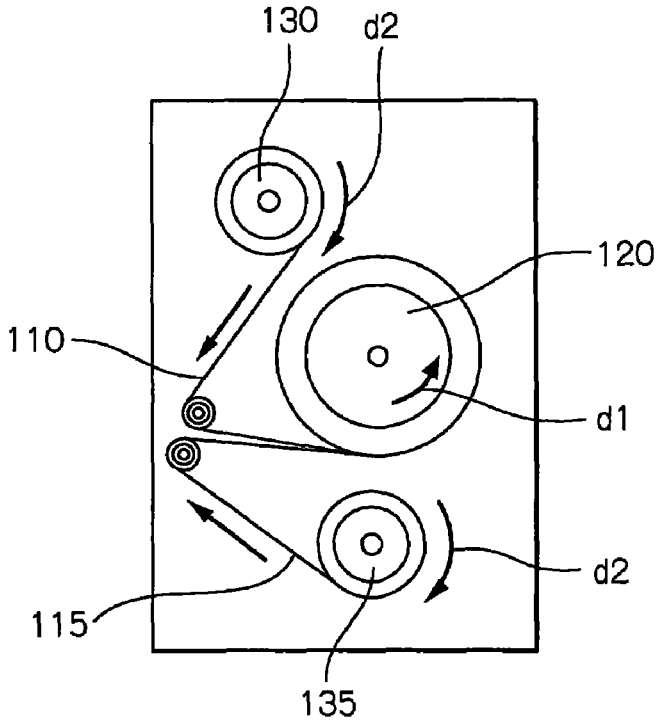
FIG. 8 is an explanatory view useful for understanding the rotational directions of the drum and reels included in the embodiment in storing operation.

Next, a storing operation will be described with reference to FIGS. 2 and 8. The drum 120 is rotated in a direction of winding up the tapes by the driving motor 140, and the rotation is transmitted to the drum shaft 121 via the drum gear 142. At this time, due to the drum 120 being rotated in the direction of arrow d1 which is the winding direction, the tapes 110 and 115 are wound up, and the reels 130 and 135 around which the other ends of the tapes are wound are rotated in the direction of arrow d2.

Figure 9:
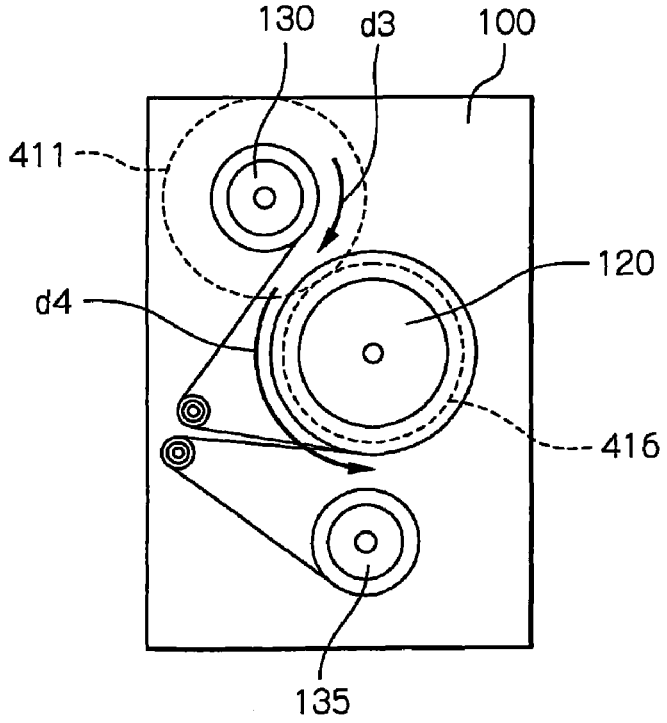
FIG. 9 is an explanatory view useful for understanding the rotational directions of the reel gears included in the embodiment in storing operation.

In accordance therewith, as shown in FIG. 9, the reel shaft 131 connected to the reel 130 via the torque limiter 132 is rotated in the direction of arrow d3, and the rotation of the drum gear 416 is transmitted in the direction of arrow d4 through the reel gear 411. With respect to the one-way clutch 425 at this time, because the one-way clutch 425 is rotated in the d4 direction and the drum shaft 121 is rotated in the d1 direction, both are rotated counterclockwise.

Figure 3C:
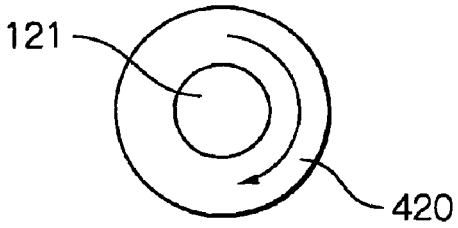
Figure 10:
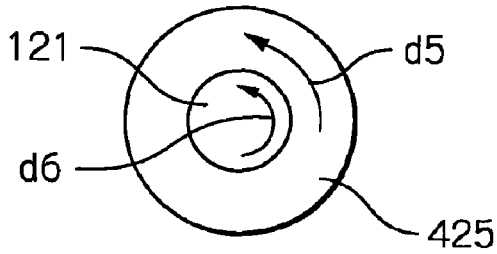
FIGS. 10 and 11 are explanatory views useful for understanding the rotational directions of the one-way clutch included in the embodiment.
Figure 11:
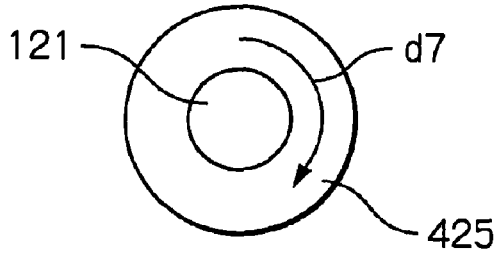

As shown in FIG. 10, when the angular speed d5 of the one-way clutch 425 is slower than the angular speed d6 of the drum shaft 121, the relative angular speed of the one-way clutch 425 with respect to the drum shaft 121 is, as shown by an arrow d7 of FIG. 11, of a clockwise direction, and therefore, the one-way clutch 425 is idled as shown in FIG. 3C.

Figure 3D:
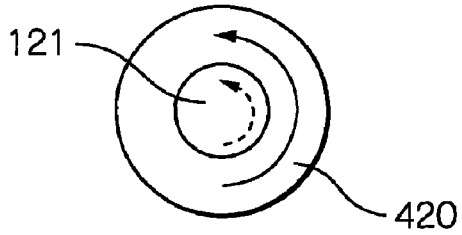
Figure 12:
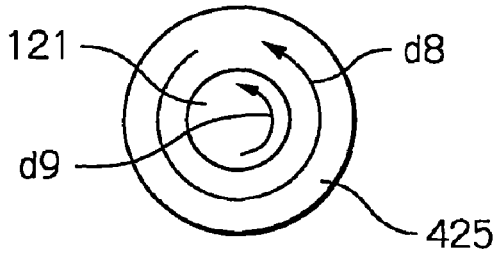
FIGS. 12 and 13 are explanatory views useful for understanding the angular speed of the one-way clutch included in the embodiment.
Figure 13:
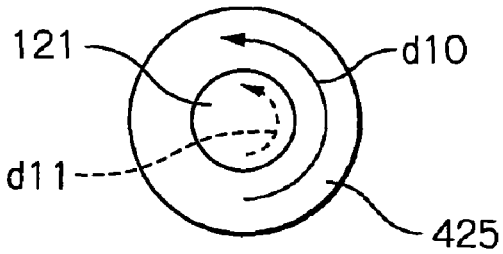

As shown in FIG. 12, when the angular speed d8 of the one-way clutch 425 is faster than the angular speed d9 of the drum shaft 121, the relative angular speed of the one-way clutch 425 with respect to the drum shaft 121 is, as shown by an arrow d10 of FIG. 13, of a counterclockwise direction. Therefore, as shown in FIG. 3D, the one-way clutch 425 is locked, and the drum shaft 121 as well starts rotating at a speed which is the same as the one-way clutch 425 as shown by an arrow d11.

Therefore, the reel shaft 131 is driven to rotate by the rotation of the reel 130. However, a rotational speed of the reel shaft 131 is up to an angular speed at which the angular speed of the one-way clutch 425 is made the same as the angular speed of the drum shaft 121. Further, because the reel shaft 136 is transmitted at a gear ratio of 1:1 with the reel shaft 131 via the drum gear 405, the reel shaft 136 is rotated at the same angular speed as the reel shaft 131.

Given that the angular speed of the drum 120 is WY1, the angular speed of the reels 130 and 135 rotated by the tapes wound around the drum is XY2, and the maximum driven-rotational speed of the reel shafts 131 and 136 driven to rotate by the torque limiters 132 and 137 connected to the reels is WY3, because the opposite ends of the tapes are respectively wound up, the angular speeds are determined in accordance with a tape speed and a tape wound radius. Given that a tape speed is VT, then $$VT=WY2\times RA1 \text{ and } VT=WY1\times RA2,$$

$$WY2\times RA1=WY1\times RA2, \text{ and}$$

$$WY2=(RA2/RA1)\times WY1$$

According to expressions (6) and (7), $$WY2=[(ra2\times ka2)/(ra1\times ka1)]\times WY1. \tag{41}$$

According to expressions (8) and (9), $$WY2=[(ra2\times ka2)/(ra1\times ka1)]\times WY1>[(ra2\times 1)/(ra1\times T1)]\times WY1, \text{ and}$$

$$WY2>[ra2/(ra1\times T1)]\times WY1. \tag{42}$$

Because WY3 is determined in accordance with the angular speed WY1 of the drum 120 and the numbers of teeth of the drum gear 416 and the reel gear 411, $$WY3=(ZA4/ZA3)\times WY1. \quad (43)$$

According to expression (24), because of the relationship ZA4/ZA3<ra2/(ra1×T1), $$WY3<[ra2/(ra1\times T1)]\times WY1. \quad (44)$$

According to expressions (42) and (44), $$WY3<[ra2/(ra1\times T1)]\times WY1<WY2. \quad (45)$$

The device 100A is configured such that the reel speed WY2 is always faster than the reel shaft speed WY3.

Figure 14:
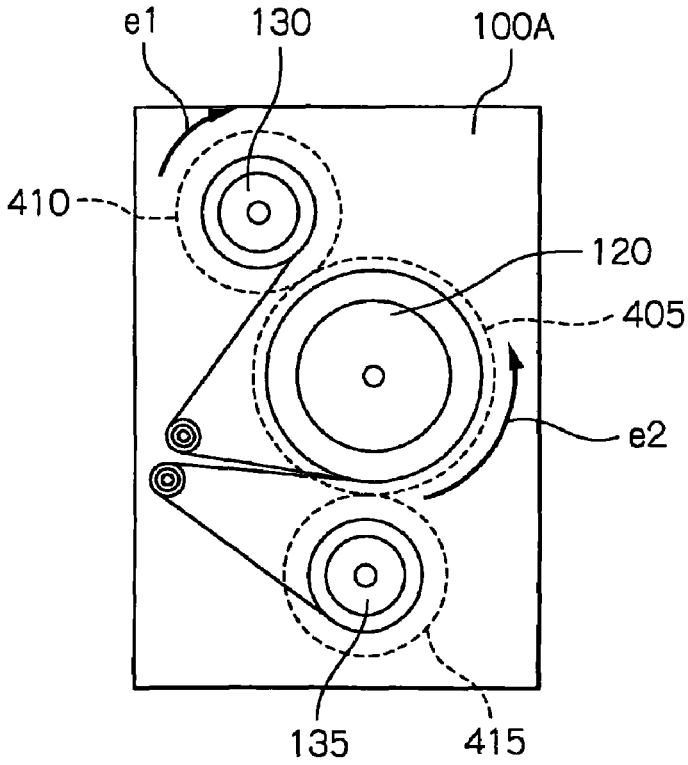
FIG. 14 is an explanatory view useful for understanding the rotational directions of the drum gear and the reel gears included in the embodiment.

Thus, the reel shafts 131 and 136 are always rotated slower in angular speed than the reels 130 and 135, and a difference between the rotational speeds is absorbed by the torque limiters 132 and 137. Further, at this time, as shown in FIG. 14, when the reel shaft 131 is rotated in the direction of arrow e1, the reel gear 410 is rotated, and the drum gear 405 is rotated counterclockwise which is an arrow e2 direction. Therefore, with respect to the one-way clutch 420, both of the drum shaft 121 and the one-way clutch 420 are rotated counterclockwise.

The conditions when the one-way clutch 420 is idled and locked are the same as the one-way clutch 425 described above. Given that the rotational speed of the drum gear 405 is WY4, because WY4 is determined in accordance with the angular speed WY3 of the reel shaft 131 and the number of teeth of the drum gear 405, $$WY4=(ZA1/ZA2)\times WY3. \quad (46)$$

According to expression (10), $$ZA1/ZA2<ra1/(ra2\times T2), \text{ and}$$

$$WY4<[ra1/(ra2\times T2)]\times WY3. \quad (47)$$

According to expression (44), a speed as WY3 is $$WY3<[ra2/(ra1\times T1)]\times WY1 \quad (48)$$

$$WY4<[ra1/(ra2\times T2)]\times[ra2/(ra1\times T1)]\times WY1,$$

$$WY4<[(ra1\times ra2)]/(ra2\times T2\times ra1\times T1)]\times WY1, \text{ and}$$

$$WY4<[1/(T2\times T1)]\times WY1. \quad (49)$$

According to expressions (8) and (9), because of the relationship 1<T1 and 1<T2, the relationship (T2×T1)>1 is established. Therefore, $$WY4<WY1. \quad (50)$$

Figure 15:
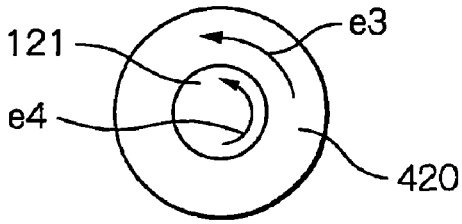
FIGS. 15 and 16 are explanatory views useful for understanding the angular speed of the one-way clutch included in the embodiment.
Figure 16:
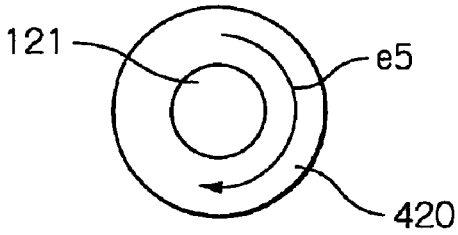

As shown in FIG. 15, because the angular speed e3 of the one-way clutch 420 fixed to the drum gear 405 is slower than the angular speed e4 of the drum shaft 121, the relative angular speed of the one-way clutch 420 with respect to the drum shaft 121 is of the clockwise direction as shown by an arrow e5 of FIG. 16, and the one-way clutch 420 is idled.

Therefore, the drum gear 405 is rotated by the transmission from the reel gear 410. However, because the drive is not transmitted to the drum shaft 121, there is no effect on the drum 120 in storing operation. In this way, the reel shafts are rotated even in storing operation, and thus, given that the angular speed of the torque limiters in storing operation is TB2, then $$TB2=(\text{angular speed of the reels})-(\text{angular speed of the reel shafts}) \quad (51)$$

is formed. It is thus possible to slow down the angular speed by the amount corresponding to the rotation of the reel shafts as compared with expression (12) for the angular speed in accordance with the prior art.

A comparison with the prior art will be made with reference to the specific example N1 described earlier. Given that the angular speed of the torque limiter in feeding operation is TB1, and the angular speed of the torque limiter in storing operation is TB2, then the angular speed TB1 of the torque limiter in feeding operation will be determined. Because the numbers of teeth ZA1 and ZA2 in feeding operation are the same as the prior art, $$TB1(\text{maximum value})=18.12$$

is formed.

On the other hand, to determine the angular speed TB2 of the torque limiter in storing operation, with respect to the reels 130 and 135, $$\text{reel angular speed}=VA1/RA1=VA1/(ra1\times ka1). \quad (52)$$

According to expression (43), the angular speed WY3 of the reel shafts 131 and 136 is $$WY3=(ZA4/ZA3)\times WY1. \quad (53)$$

According to expression (24), $$ZA3/ZA4>(ra1\times T1)/(ra2\times 1)=(50\times 1.3)/80=0.813.$$

Because of ZA3/ZA4>0.813, the gear ratio is ZA3/ZA4=0.82.

According to the expression 53, $$WY3=(1/0.82)\times WY1=(1/0.82)\times VA1/(ra2\times ka2). \quad (54)$$

According to expressions (51), (52) and (54), $$TB2=VA1/(ra1\times ka1)-[(1/0.82)\times VA1/(ra2\times ka2)]$$
$$=VA1\times[1/(ra1\times ka1)-1/[0.82\times(ra2\times ka2)]].$$

The maximum value as TB2 is established when (ra1×ka1) takes its minimum value, and (ra2×ka2) does its maximum value, i.e. when there are no tapes on the reels, and the tapes are fully wound on the drum.

$$TB2(\text{maximum value}) = VA1\times[1/(ra1\times 1)-1/[0.82\times(ra2\times T2)]] =$$
$$1200\times[1/50-1(0.82\times 80\times 1.5)] = 11.8$$

In this way, because of the relationship TB2=11.8 with respect to the angular speed TA2=24 in the prior art represented by expression (15), it is possible to greatly slow down the angular speed in storing operation.

Further, with respect to the maximum values in both storing and feeding operations, because the maximum value in the present embodiment is equal to 18.12 in feeding operation as compared with the maximum value 24 in storing operation in the prior art, it is possible to greatly slow down the maximum angular speed of the torque limiters. Moreover, in addition to the angular speed of the torque limiters, it is possible to reduce the expensive one-way clutches into two in the present embodiment, which leads to a reduction in the cost.

In the illustrative embodiment described above, the power of the driving motor 140 is transmitted to the drum shaft 121 to operate the device 100A. It is however possible to operate the media storing and feeding device by transmitting the power of the driving motor 140 to the reel sides. An alternative embodiment will be described hereinafter in which the driving force is transmitted to the reel sides.

Figure 17:
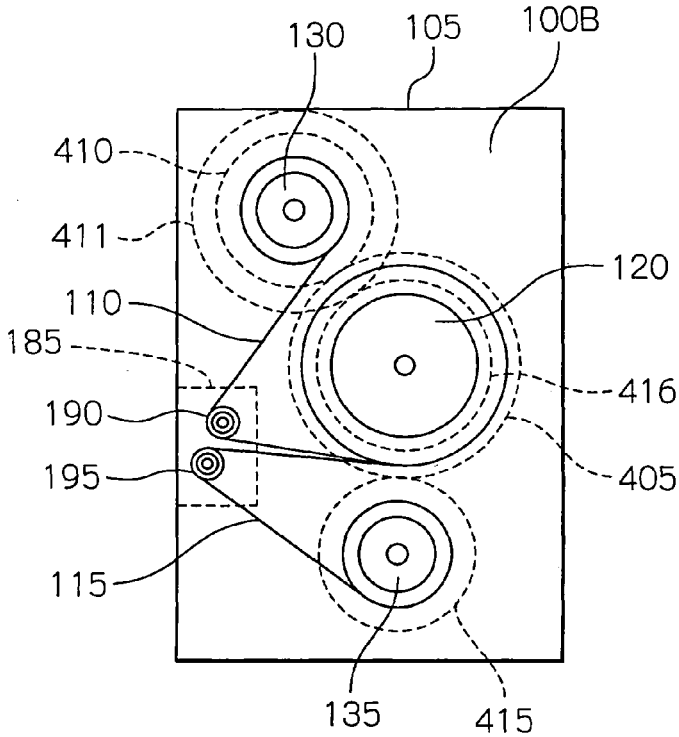
FIG. 17 explanatorily shows in a side view, like FIG. 1, the main part of an alternative embodiment.
Figure 18:
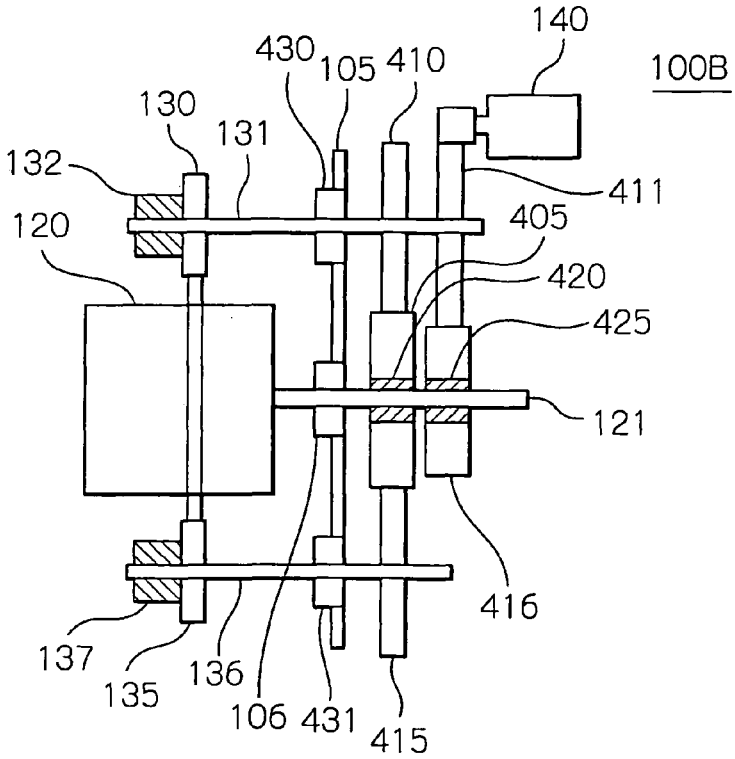
FIG. 18 explanatorily shows in a plan view, like FIG. 2, the main part of the alternative embodiment shown in FIG. 17.

FIGS. 17 and 18 explanatorily show in a side and a plan view, respectively, the main part of a media storing and feeding device 100B in accordance with the alternative embodiment, which may substantially be the same as the illustrative embodiment shown in and described with reference to FIGS. 1 and 2, except that the power of the driving motor 140 is directly transmitted to the reel gear 411.

Figure 19:
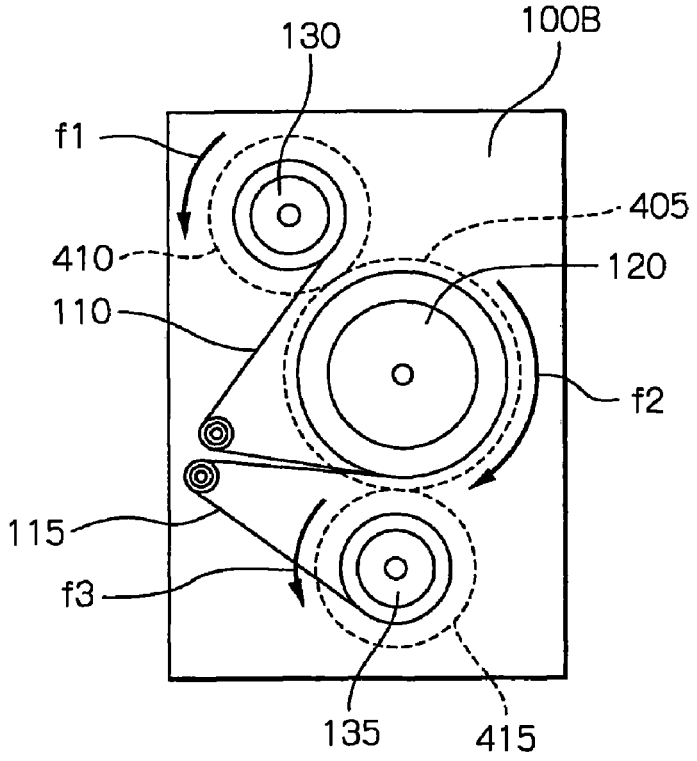
FIGS. 19 and 20 are explanatory views useful for understanding the rotational directions of the drum gear and reel gears included in the alternative embodiment in feeding operation.

A feeding operation of the device 100B will be described with reference to FIG. 19. The reel shaft 131 is rotated in the direction of winding up the tapes, i.e. in the direction of arrow f1 by the driving motor 140, and the rotation is transmitted to the reel shaft 131 via the reel gear 411. At this time, the drum gear 405 is rotated in the direction of arrow f2 via the reel gear 410 fixed to the reel shaft 131, and the drum gear 416 that makes drive transmission with the reel gear 141 as well is rotated in the direction of arrow f2.

Figure 20:
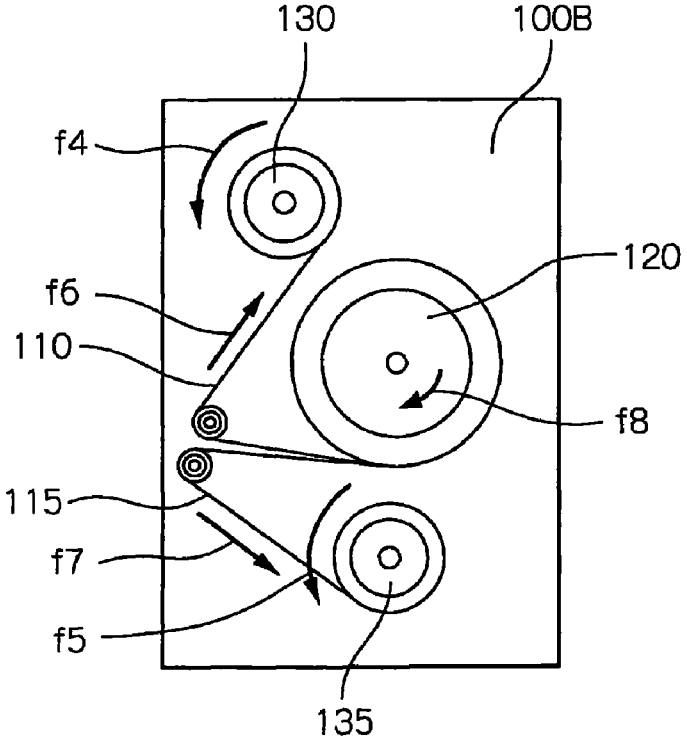

On the other hand, the reel gear 415 that makes drive transmission with the drum gear 405 is rotated in the direction of arrow f3. At this time, as shown in FIG. 20, when the reels 130 and 135 connected to the reel shafts 131 and 136 via the torque limiters 132 and 137 are rotated in the direction of arrows f4 and f5 which is the winding direction, the tapes 110 and 115 are wound up, and due to the tapes being wound up in the direction of arrows f6 and f7, the drum 120 around which the other ends of the tapes are wound is rotated in the direction of arrow f8.

Figure 21:
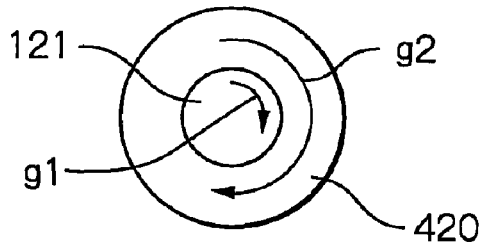
FIGS. 21 through 24 are explanatory views useful for understanding the angular speed of the one-way clutch included in the alternative embodiment.
Figure 22:
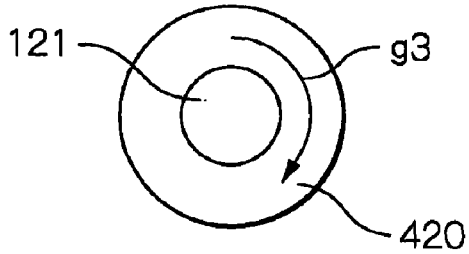

At this time, with respect to the one-way clutch 420, both of the one-way clutch 420 and the drum shaft 121 are rotated clockwise. As shown in FIG. 21, when the angular speed g1 of the drum shaft 121 is slower than the angular speed g2 of the one-way clutch 420, the relative angular speed of the one-way clutch 420 with respect to the drum shaft 121 is of the clockwise rotation as shown by an arrow g3 in FIG. 22, and therefore, the one-way clutch 420 is idled as shown in FIG. 3C.

Figure 23:
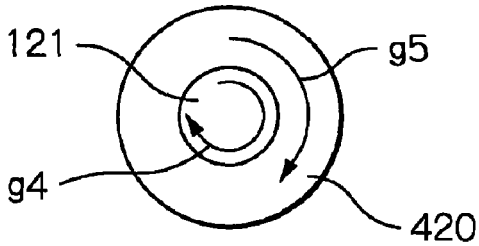
Figure 24:
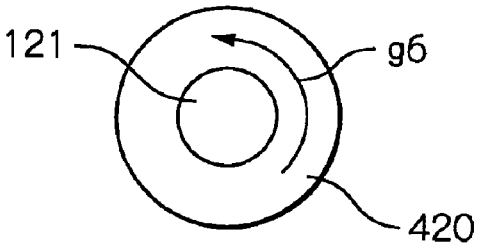

As shown in FIG. 23, when the angular speed g4 of the drum shaft 121 is faster than the angular speed g5 of the one-way clutch 420, the relative angular speed of the one-way clutch 420 with respect to the drum shaft 121 is of the counterclockwise rotation as shown by an arrow g6 of FIG. 24. Therefore, the one-way clutch 420 is locked as shown in FIG. 3D. Because of that, the drum shaft 121 is thus configured to be rotated at a speed slower than the one-way clutch 420.

Further, because the one-way clutch 425 as well has the same locking and idling directions as the one-way clutch 420, when the angular speed of the drum shaft 121 is slower than the angular speed of the one-way clutch 425, the one-way clutch 425 is idled. When the angular speed of the drum shaft 121 is faster than the angular speed of the one-way clutch 425, the one-way clutch 425 is locked. Therefore, the drum shaft 121 is configured to be rotated at a speed slower than the one-way clutch 425.

Therefore, the drum shaft 121 is driven to rotate by the rotation of the reel 130, and the rotational speed thereof is up to an angular speed at which the angular speed of the one-way clutch 420 or the one-way clutch 425 is made substantially the same as the angular speed of the drum shaft 121. Because the drum gear 405 and the reel gears 410 and 415 satisfy expression (10), a gear ratio is set such that a speed at which the reel shafts 131 and 136 wind up the tapes is always faster than a speed at which the drum 120 rewinds the tapes even when the drum radius and the reel radii are changed by winding-up and rewinding the tapes.

Further, because the drum gear 416 and the reel gear 411 satisfy the relationship represented by expression (24), a gear ratio is set such that a speed at which the reel shaft 131 winds up the tapes is always slower than a speed at which the drum 120 rewinds the tapes even when the drum radius and the reel radii are changed by winding-up and rewinding the tapes. Therefore, with respect to the driven-rotation of the drum shaft 121, when the one-way clutch 420 is locked earlier, the speed is thereby regulated, and at that time, a speed at which the reels wind up the tapes is faster than a speed at which the drum 120 rewinds the tapes. A difference between the rotational speeds is absorbed by the torque limiters 132 and 137.

Figure 25:
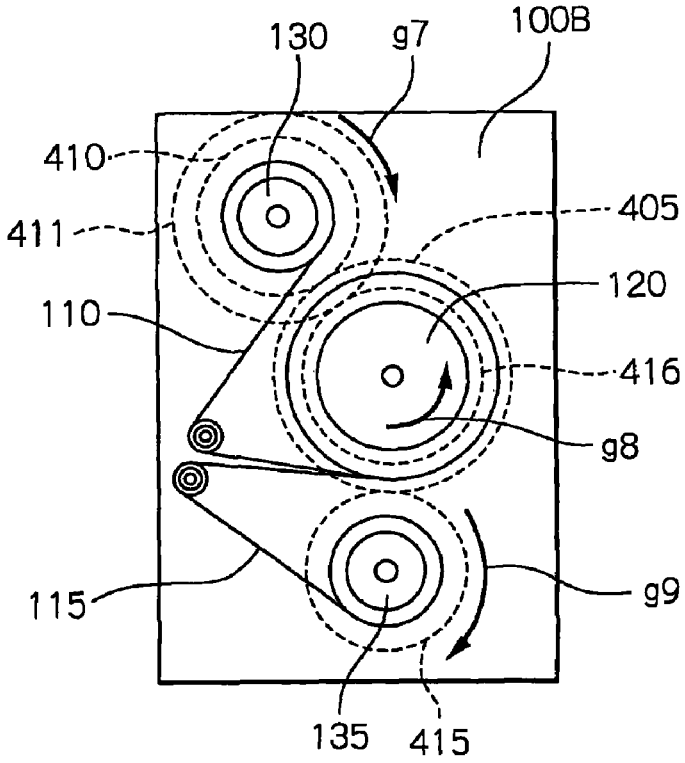
FIG. 25 is an explanatory view useful for understanding the rotational directions of the drum gear and the reel gears included in the alternative embodiment in storing operation.

Next, a storing operation of the device 100B will be described hereinafter with reference to FIG. 25. The driving motor 140 rotates the reel shaft 131 in its rewinding direction, i.e. in the direction of arrow g7, and the reel gear 410 and the reel gear 411 which are fixed to the reel shaft 131 are rotated clockwise, i.e. in the direction of arrow g7, and the drum gears 405 and 416 are rotated counterclockwise, i.e. in the direction of arrow g8.

Further, the rotation of the reel shaft 136 is transmitted at a gear ratio of 1:1 with the reel shaft 131 via the drum gear 405. Thus, the reel shaft 136 is rotated in the direction of arrow g9 at an angular speed which is the same as that of the reel shaft 131.

Figure 26:
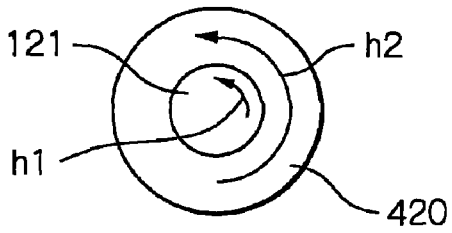
FIGS. 26 through 29 are explanatory views useful for understanding the angular speed of the one-way clutch included in the alternative embodiment.
Figure 27:
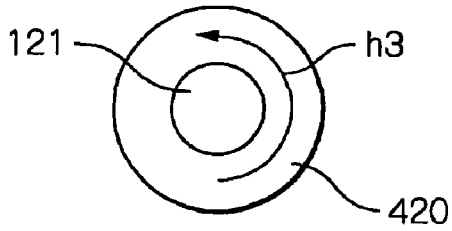

At that time, the relationship between the drum shaft 121 and the one-way clutches 420 and 425 is as follows. As shown in FIG. 26, when the angular speed h1 of the drum shaft 121 is slower than the angular speed h2 of the one-way clutches 420 and 425, the relative angular speed of the one-way clutches with respect to the drum shaft 121 is, as shown by an arrow h3 of FIG. 27, of the counterclockwise direction. Therefore, the one-way clutch 420 is locked as shown in FIG. 3D.

Figure 28:
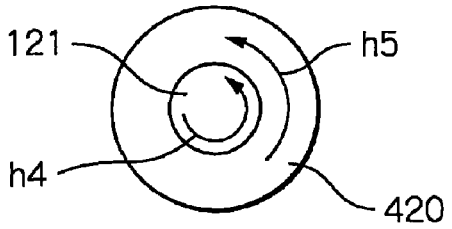
Figure 29:
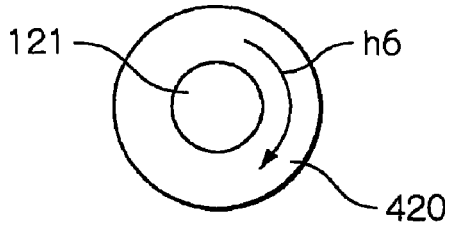

As shown in FIG. 28, when the angular speed h4 of the drum shaft 121 is faster than the angular speed h5 of the one-way clutches 420 and 425, the relative angular speed of the one-way clutches with respect to the drum shaft 121 is, as shown by an arrow h6 of FIG. 29, of the clockwise direction. Therefore, the one-way clutch 420 is idled as shown in FIG. 3C. Thus, the drum shaft 121 follows one of the one-way clutches 420 and 425 which is rotated faster, and the other one one-way clutch is idled because the drum shaft 121 is rotated faster.

The driving system of the one-way clutch 420 is set to have its gear ratio such that a speed at which the drum 120 winds up the tapes is always slower than a speed at which the reel shafts 131 and 136 rewind the tapes according to expression (10), and the driving system of the one-way clutch 425 is set to have its gear ratio such that a speed at which the drum 120 winds up the tapes is always faster than a speed at which the reel shaft 131 rewinds the tapes according to expression (24).

Therefore, because the one-way clutch 425 is rotated faster than the one-way clutch 420, the drum shaft 121 follows the one one-way clutch 425. At this time, because a speed at which the drum 120 winds up the tapes is faster than a speed at which the reels rewind the tapes, a difference between the rotational speeds is absorbed by the torque limiters 132 and 137.

The above description is directed to the drum gear 142 being rotated by the driving motor 140. However, the invention is not limited to the specific embodiments, but it goes without saying that the drum shaft 121 and the reel shafts 131 and 136 may be directly rotated.

The entire disclosure of Japanese patent application No. 2007-284264 filed on Oct. 31, 2007, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A media storing and feeding device comprising:

a first reel that winds up a first tape;

a first reel shaft that rotates said first reel;

a drum that winds up the first tape and a medium together; and a drum shaft that rotates said drum, whereby between said first reel and said drum the first tape is wound up or rewound to thereby store or feed the medium, respectively, said device further comprising:

a first transmission that transmits a first rotation between said drum shaft and said first reel shaft in a first direction of winding the tape; and a second transmission that transmits a second rotation between said drum shaft and said first reel shaft in a second direction of rewinding the first tape, said first transmission preventing, when said second transmission transmits the second rotation, the first rotation from being transmitted, said second transmission preventing, when said first transmission transmits the first rotation, the second rotation from being transmitted, said device further comprising:

a second reel that winds up a second tape; and a second reel shaft that rotates said second reel, said drum winding up the second tape together with the first tape and the medium with the medium in between, wherein said second transmission transmits the second rotation between said first reel shaft and said second reel shaft, and said first transmission transmits the first rotation from said drum shaft to said first and second reel shafts.

2. The device in accordance with claim 1, wherein said first transmission transmits the first rotation from said drum shaft to said first reel shaft so that said first reel shaft rotates at a speed slower than a speed at which said drum winds the tape.

3. The device in accordance with claim 1, wherein said second transmission transmits the second rotation from said drum shaft to the first reel so that said first reel shaft rotates at a speed faster than a speed at which said drum rewinds the tape.

4. The device in accordance with claim 1, wherein said first transmission and said second transmission comprise respective one-way clutches that prevent the rotation between said drum shaft and said first reel shaft.

5. The device in accordance with claim 4, wherein said first transmission and said second transmission respectively comprise a first drum gear and a second drum gear, said first and second drum gears being supported on a same drum shaft via respective one-way clutches to rotate.

6. The device in accordance with claim 1, further comprising a driving source that feeds a power to drive said drum shaft.

7. The device in accordance with claim 1, further comprising a driving source that feeds a power to drive said first reel shaft.

* * * * *